US005178285A

United States Patent [19]

Soucy

[11] Patent Number: 5,178,285

[45] Date of Patent: Jan. 12, 1993

[54] PEN HOLDER

[76] Inventor: Norman F. Soucy, 500 Essex St., Lynn, Mass. 01902

[21] Appl. No.: 557,126

[22] Filed: Jul. 23, 1990

[51] Int. Cl.[5] ..... B43K 23/00

[52] U.S. Cl. ..... 211/69.5

[58] Field of Search ..... 211/69.5, 69.1

[56] References Cited

U.S. PATENT DOCUMENTS 2,132,121 10/1938 Nudelman ..... 211/69.5 X
2,484,773 10/1949 Wuestman ..... 211/69.5
3,245,164 4/1966 Arenson ..... 211/69.5
4,090,613 5/1978 McPherson ..... 211/69.5
4,781,352 11/1988 Youngman ..... 248/205.3 X

*Primary Examiner*—Reinaldo P. Machado
*Attorney, Agent, or Firm*—Samuels, Gauthier & Stevens

[57] ABSTRACT

A pen set having a base, which base is adhesively secured to a countertop. The pen set includes a jacking mechanism within the base whereby the base may be lifted from the countertop without damage to either the countertop or the base.

12 Claims, 3 Drawing Sheets

PEN HOLDER

BACKGROUND AND BRIEF SUMMARY OF THE INVENTION

1. Field of Invention

This invention relates to a permanent pen set and a pen permanently secured to the holder.

Banks, supermarkets, hotels, department stores and numerous other enterprises catering to the public have long struggled with having to provide their customers with pens to write checks and fill out various forms. Traditionally, such businesses have provided their customers with cheap, plastic ballpoint pens. This has proved costly because, in addition to the direct costs associated with providing such pens, employee time and efficiency and the average time to service a customer are often adversely affected when such pens are misplaced, broken or taken by customers.

Within the past few years, this problem has been somewhat alleviated by the introduction of pen sets consisting of an unbreakable pen attached to a non-removeable base by a wire cable. One form of such a pen set is disclosed in U.S. Pat. No. 4,321,763.

There are some drawbacks to these pen sets. If it is desired to move the pen set from one location to another, typically the adhesive bond between the set and the surface to which it is attached is very strong. Solvents and/or chisels must be used to break the adhesive bond, working from the perimeter of the pen set inwardly. This typically results in defacement or marring of the counter surface and/or destruction to the pen set.

Also, these pen sets, although functionally attractive and strategically located in a selling environment, have no capability to promote products or services. Typically they have a company's name and logo permanently imprinted on the base. They therefore fail to capitalize on an excellent opportunity to advertise products.

In the present invention, a pen set is provided wherein the pen set can only be removed with a threaded fastener or the like. The pen set includes a jacking mechanism whereby when the set is to be moved, it is jacked off the counter surface to prevent scratching or marring the surface. Further, advertising inserts may be easily inserted in the pen set.

Broadly the invention comprises a pen set having a base which receives a cylindrical pen holder having a flat wall. The flat wall prevents rotation of the holder. A fastener secures the holder to the base by engaging a threaded opening in the base. To remove the base, the pen holder is removed. A tool passes through and engages the threaded aperture and passes through the base and contacts the surface. The tool is rotated lifting the base from the surface. In the preferred embodiment a removal jack pad is received in the floor of the base. The end of the tool contacts the pad to distribute the forces acting on the surface.

DESCRIPTION OF THE PREFERRED EMBODIMENT(S)

Figure 2:
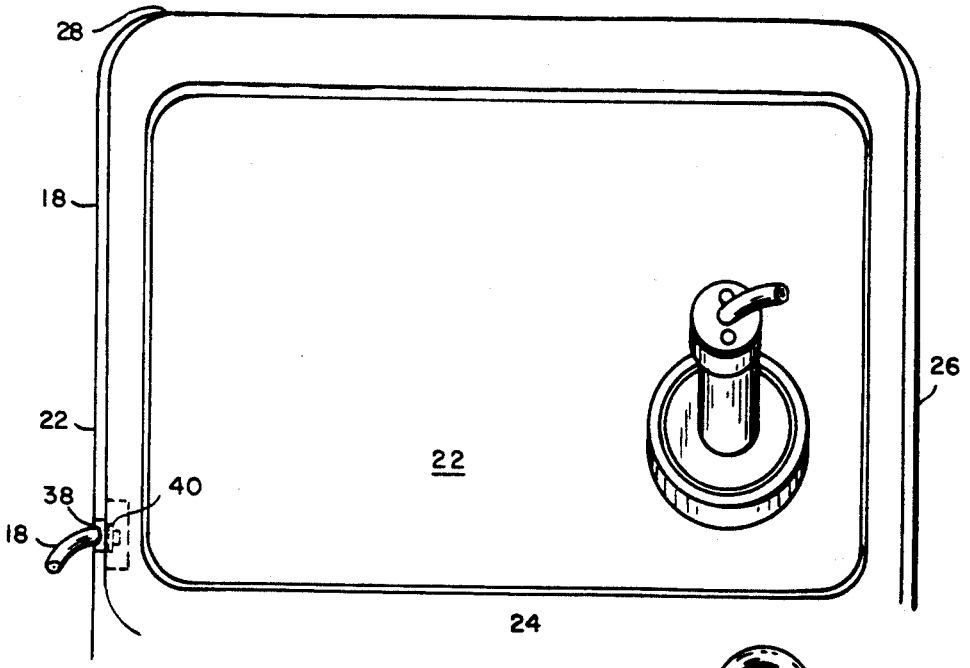
FIG. 2 is a top view of the pen set.
Figure 1:
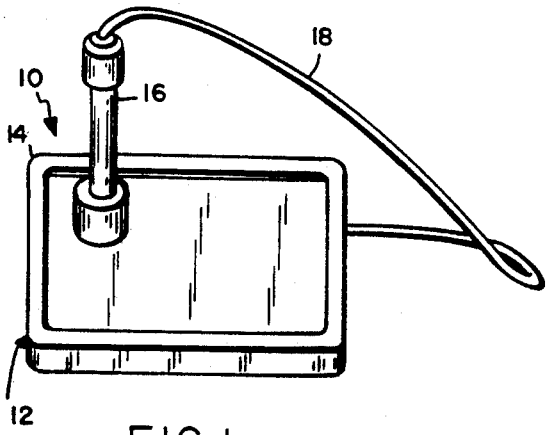
FIG. 1 is a perspective view of a pen set embodying the invention.
Figure 3:
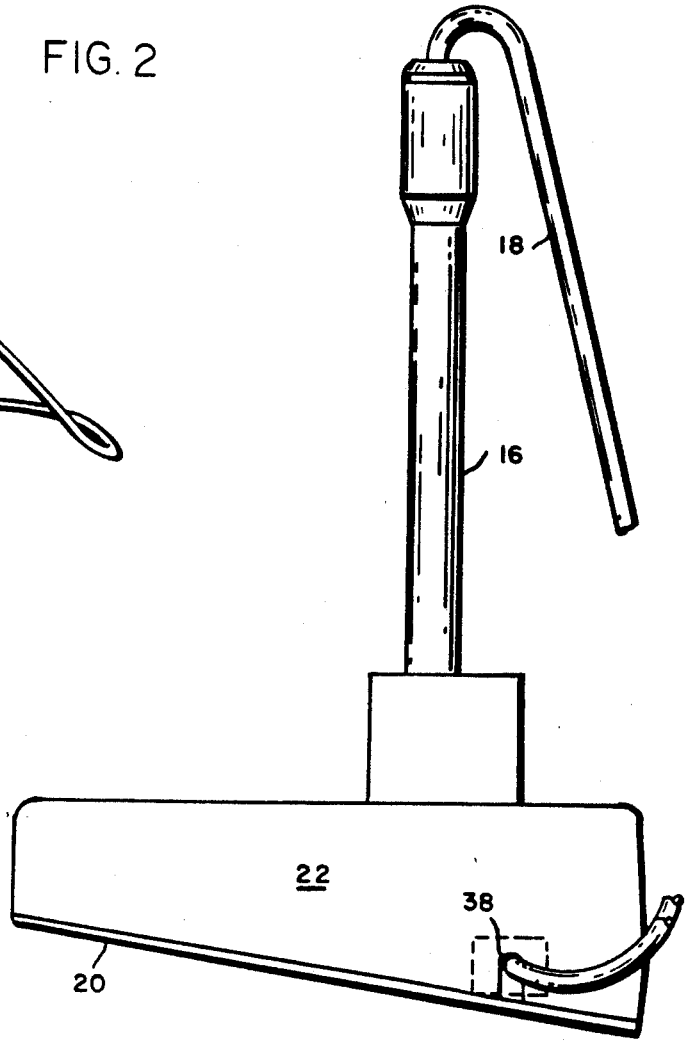
FIG. 3 is a side view of the pen set.

Broadly the invention comprises a pen set 10 including a base 12, a pen holder 14, a pen 16 and a cable 18 which secures the pen to the base. The base comprises a bottom 20, side walls 22, 24, 26 and 28, which define a perimeter, and a top surface 30 which is recessed below the upper edges of the walls 22–28. A clear cover 32 is received over the top surface 30 and a number of sheets of advertising cards 34 or the like are disposed between the top clear cover 32 and the top surface 30.

The base 12 includes two openings, a through opening 36 from the top to the bottom of the base and an opening 38 in the side 22. The cable 18 passes through the opening or hole 38 in the wall 22. The cable passes through a washer 40 and a ferrule is crimped to the end of the cable.

Figure 4:
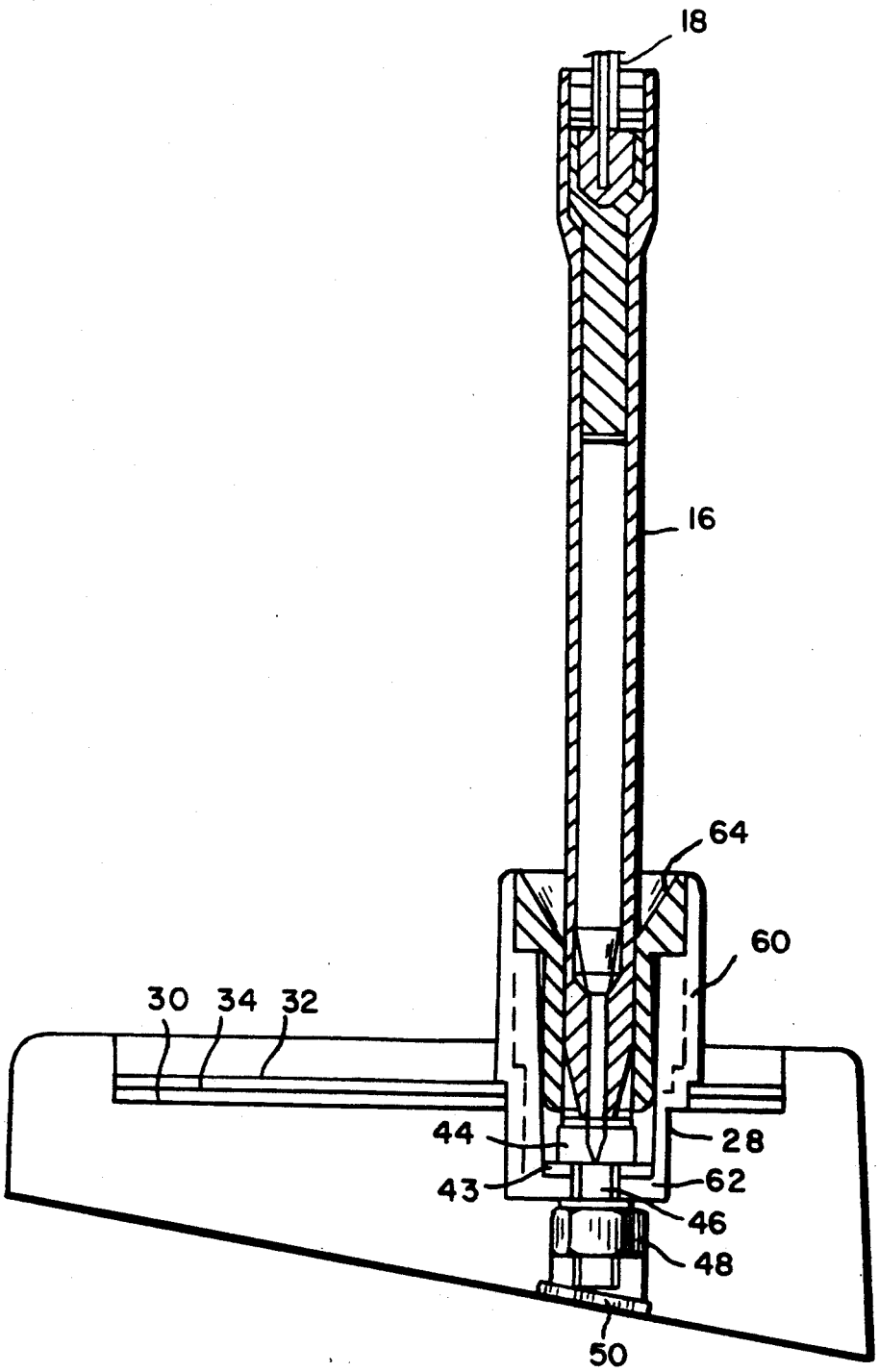
FIG. 4 is a side sectional view of the pen set.
Figure 6:
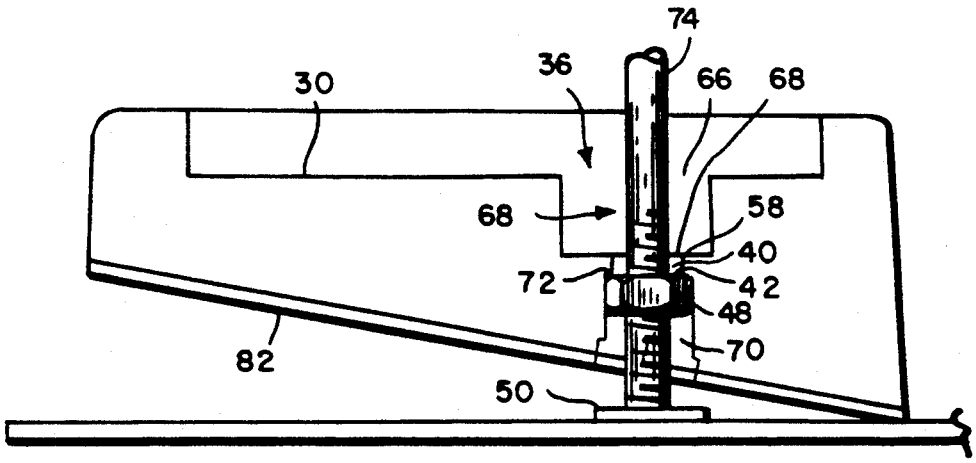
FIG. 6 is a side view of the pen set with the pen holder removed and the tool for lifting the base shown in place.

Referring to FIGS. 4 and 6, the through opening 36 in the base includes an apertured floor 42 on which rests a washer 43. Received in the aperture is an allen cap screw 44. The shaft 46 of the screw 44 is threaded through a nut 48, the cap contacting the washer 43. The pen holder 14 is secured in the opening 36 by the screw 44 engaging the nut 48. The bottom of the holder 14 is seated on the floor 42. A circular jack pad 50 is frictionally secured in the bottom 20 in register with the opening 36.

Figure 5:
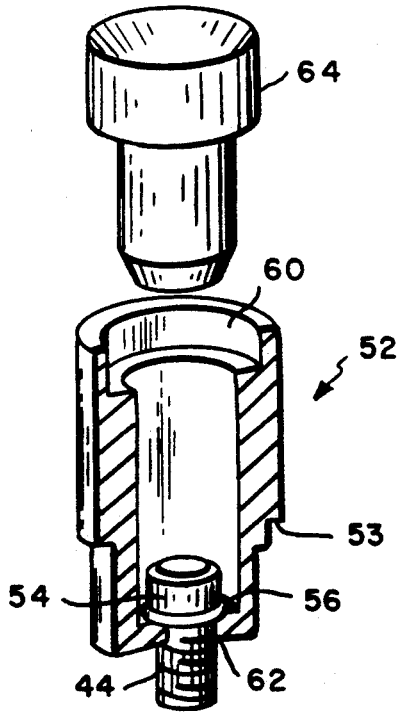
FIG. 5 is a perspective view of the pen holder.

Referring to FIG. 5, the pen holder 14 comprises an outer cylindrical section 52 and an inner cylindrical section 64. The outer cylindrical section 52 has a stepped outer section 53, which when the holder is seated engages the cover 32. The inner cylindrical section 64 which receives the pen 6 is frictionally engaged within the outer cylindrical section 52 in such fashion as to trap the screw 44 and the washer 43 while permitting the screw 44 to freely turn. A next lower section 54 includes a flat wall 56 which mates with a corresponding surface 58 in the opening 36 to prevent rotation of the holder 14. As shown, the holder 14 has a central passageway 60 and a floor 62. The floor 62 is characterized by an opening (not shown) through which the screw 44 passes when the holder 14 is secured to the base. If desired, the inner cylindrical section 64 could be formed so as to disengage from the outer cylindrical section 52 to allow sleeves of different sizes to be used with the same basic pen holder to accommodate different sized pens. If desired, the sleeve 64 could be formed integrally with the pen holder, or the upper cylindrical section 52 formed to accept the pen directly as long as there is a hole through which a threaded fastener or the like can pass.

Referring to FIG. 6, the through opening 36 is shown in greater detail and includes a first upper enlarged cylindrical section 66 and a next lower succeeding section 68 diminished in reference to the section 66 to form the floor 42. The section 68 is characterized by the flat wall 58. The opening 68 includes a next lower succeeding enlarged section 70. The sections 68 and 70 define a shoulder 72. Press fit into the section 70 against the shoulder 72 is the nut 48.

In order to remove the cover 32 so that different advertisements (visual media) may be placed in the base, the pen holder 14 is removed to disengage the cover 32.

The cover 32 is removed and a new advertisement placed on the top surface 30 and the pen holder 14 screwed into place.

When it is desired to remove the entire pen set, the pen holder is removed and referring to FIG. 6 a threaded shaft 74, which can simply be a longer allen screw, is threaded through the nut 48. The shaft is turned, causing it to push against the jack pad 50 which releases from the bottom 20 and pushes against the surface to which the set has been secured. Thus, the shaft functions as a jack to lift the base from the surface. It has been discovered with this technique that these bases can be much more easily removed form their supporting surface without defacement or injury to either the pen holder or the surface. Further, in those cases where it has been found difficult to remove the pen holder, a solvent or the like may be introduced through the nut and then the jacking action effected, resulting in the solvent working on those points where the strength of adhesive is the greatest.

Figure 7:
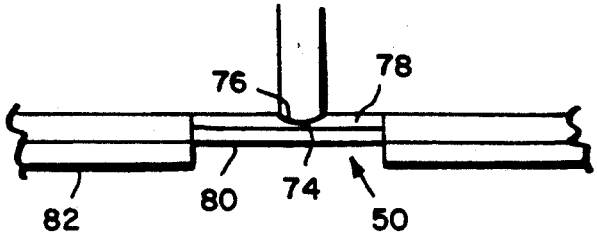
FIG. 7 is a side view of the jacking pad.

Referring to FIG. 7, the jack pad 50 preferably has a recess 76 on its upper surface to locate the end of the shaft 74. Also, the jack pad can comprise two layers. A hard upper layer 48 and a soft or resilient lower layer 80. An adhesive layer 82 secures the base to the surface 84. However, there is no adhesive where the jack pad is located. This allows the jack pad to pass through the adhesive unimpeded.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A pen set assembly which comprises:

a base having a bottom plate, a top plate and walls joining the top and bottom plates, the walls defining a perimeter;

the top plate recessed below the upper edges of the walls;

a transparent cover joined to the top plate;

a pen holder adapted to hold a pen secured in the base and received in an opening in the base;

means to secure the bottom plate to a surface;

locking means within the base to secure the holder to the base and to receive jacking means; and jacking means adapted to pass through and engage the locking means and to contact the surface whereby the jacking means can lift the base from the surface.

2. The assembly of claim 1 which includes:

a removeable jack pad secured in the bottom of the base and in register with the means to receive the jacking means.

3. The assembly of claims 1 or 2 wherein the opening includes an apertured floor, the pen holder when secured to the base is seated on the floor, the means to secure the holder comprises a threaded fastener passing through the holder and the opening and threaded to the locking means.

4. The assembly of claim 3 wherein the threaded fastener is an allen screw.

5. The assembly of claim 4 wherein the locking means is a nut.

6. The assembly of claim 1 wherein said means is an adhesive.

7. The assembly of claim 1 which includes:

a visual display between the top surface and the transparent cover.

8. The assembly of claim 1 which includes:

means to secure the transparent cover to the base.

9. The assembly of claim 8 wherein said means comprises the pen holder.

10. The assembly of claim 9 wherein said pen holder includes a stepped surface which engages the transparent cover when the pen holder is secured in the base.

11. The assembly of claim 1 which includes:

means to prevent rotation of the pen holder in the opening.

12. The assembly of claim 1 wherein the means to secure the pen holder to the base includes a threaded fastener engaging the locking means received in the base.

* * * * *